US008011484B2

(12) United States Patent
McIntyre

(10) Patent No.: US 8,011,484 B2
(45) Date of Patent: Sep. 6, 2011

(54) RECONFIGURABLE TRAVEL TRUNK

(76) Inventor: Lynne McIntyre, Romulus, MI (US)

( * ) Notice: Subject to any disclaimer, the term of this patent is extended or adjusted under 35 U.S.C. 154(b) by 2031 days.

(21) Appl. No.: 10/705,307

(22) Filed: Nov. 10, 2003

(65) Prior Publication Data

US 2005/0098403 A1 May 12, 2005

(51) Int. Cl.
*A45C 3/00* (2006.01)

(52) U.S. Cl. ..... 190/110; 190/18 A; 190/111; 190/13 H; 190/33

(58) Field of Classification Search ..... 190/110, 190/33, 13 R–15.1, 107, 13 H, 18 A, 111; 312/204; 211/113, 118
See application file for complete search history.

(56) References Cited

U.S. PATENT DOCUMENTS

| | | | | | |
|---|---|---|---|---|---|
| 158,056 | A | | 12/1874 | Fletcher | |
| 264,747 | A | | 9/1882 | Potts | |
| 395,617 | A | | 1/1889 | Eaton | |
| 485,612 | A | * | 11/1892 | Cozens | 190/13 R |
| 529,793 | A | | 11/1894 | Holm | |
| 823,700 | A | | 6/1906 | Sayer, Jr. | |
| 885,979 | A | | 4/1908 | Coe | |
| 1,062,496 | A | | 5/1913 | Paler | |
| 1,609,348 | A | | 12/1926 | Disney | |
| 1,673,730 | A | * | 6/1928 | Bartels | 190/13 R |
| 1,884,402 | A | * | 10/1932 | Devanter | 190/109 |
| 2,247,366 | A | | 7/1941 | Fridolph | |
| D152,653 | S | * | 2/1949 | Rinehart | D3/284 |
| 3,120,297 | A | * | 2/1964 | Riley | 190/110 |
| 3,376,962 | A | | 4/1968 | Adams | |
| 3,841,727 | A | | 10/1974 | Peng | 312/111 |
| D241,380 | S | | 9/1976 | Graviner | D87/1 R |
| 4,118,048 | A | | 10/1978 | Spranger et al. | 280/47.35 |
| 4,531,645 | A | * | 7/1985 | Tisbo et al. | 211/131.1 |
| 4,575,109 | A | | 3/1986 | Cowdery | 280/37 |
| 4,738,340 | A | | 4/1988 | Crespi | 190/18 R |
| 4,825,584 | A | * | 5/1989 | Raley | 43/57.1 |
| 4,887,751 | A | | 12/1989 | Lehman | 224/151 |
| 4,890,705 | A | * | 1/1990 | Pineda | 190/18 A |
| 4,966,258 | A | | 10/1990 | Hawley | 190/4 |
| 5,129,491 | A | | 7/1992 | Seidman | 190/18 A |
| D338,555 | S | | 8/1993 | Olson | D3/38 |
| 5,378,005 | A | | 1/1995 | Norton | 280/47.26 |
| 5,595,302 | A | | 1/1997 | Maydwell et al. | 206/541 |
| 5,603,558 | A | | 2/1997 | Zimmer | 312/290 |
| 5,676,223 | A | | 10/1997 | Cunningham | 190/109 |
| D394,749 | S | | 6/1998 | Ford et al. | D3/295 |
| 5,797,612 | A | | 8/1998 | Buccioni | 280/47.26 |
| 5,803,470 | A | * | 9/1998 | Smith | 280/37 |

(Continued)

*Primary Examiner* — Tri Mai
(74) *Attorney, Agent, or Firm* — Gifford, Krass, Sprinkle, Anderson & Citkowski, P.C.

(57) ABSTRACT

A versatile travel trunk may be reconfigured for numerous purposes, including a men's wardrobe, women's wardrobe, a combined wardrobe, food-carrying applications, tool and utensil accommodation, or any combination thereof. The preferred embodiment includes a body portion to which there is hinged a closable door portion. The body portion has an interior with a depth and opposing inner side walls adapted to receive one or more removable and reconfigurable shelves. A plurality of fasteners are disposed on the back portion of the back wall of the door to receive one or more modular inserts, each insert having a back surface connectable to the fasteners and a front surface with compartments adapted to carry a different set of items for a particular travel application. One or more of the shelves further include lower tracks to receive drawers that slide in and out of the body portion. The body portion preferably further includes a set of integrated wheels and a retractable handle for ease in transport.

5 Claims, 7 Drawing Sheets

U.S. PATENT DOCUMENTS

| | | | | | |
|---|---|---|---|---|---|
| 5,845,780 | A | * | 12/1998 | Allen | 206/579 |
| 5,984,154 | A | | 11/1999 | Scicluna | 224/153 |
| 6,000,509 | A | * | 12/1999 | Chisholm | 190/109 |
| 6,041,900 | A | | 3/2000 | Sadow et al. | 190/18 A |
| 6,053,587 | A | | 4/2000 | Boerder | 312/249.12 |
| 6,076,641 | A | * | 6/2000 | Kinzer et al. | 190/18 A |
| 6,102,172 | A | | 8/2000 | Dercole | 190/18 A |
| 6,179,102 | B1 | | 1/2001 | Weber et al. | 190/109 |
| D444,300 | S | | 7/2001 | Leyshon | D3/295 |
| 6,254,112 | B1 | | 7/2001 | Clegg | 280/47.19 |
| 6,347,847 | B1 | | 2/2002 | Tiramani et al. | 312/108 |
| 6,497,311 | B2 | | 12/2002 | Tiramani et al. | 190/115 |
| 6,520,514 | B2 | * | 2/2003 | Clegg | 280/47.26 |
| 6,523,653 | B2 | * | 2/2003 | Roegner | 190/109 |
| 6,533,086 | B1 | | 3/2003 | Waddell et al. | 190/18 A |
| 6,715,594 | B2 | * | 4/2004 | Milionta et al. | 190/110 |

* cited by examiner

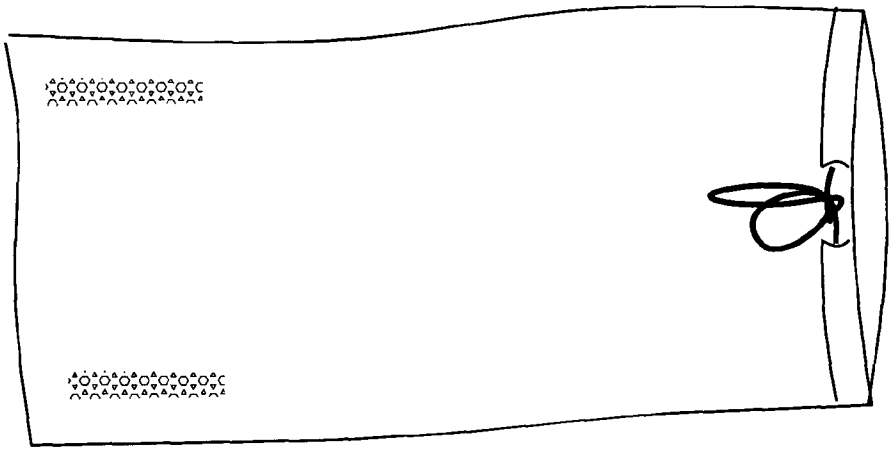
Fig - 9
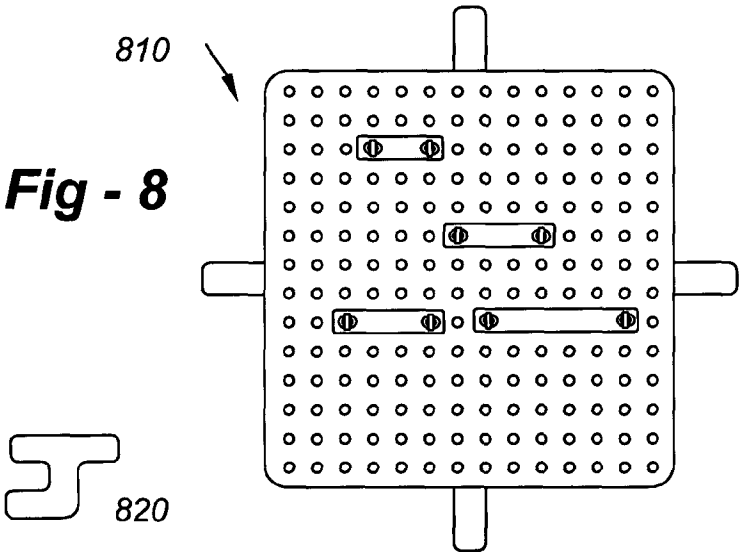
Fig - 8
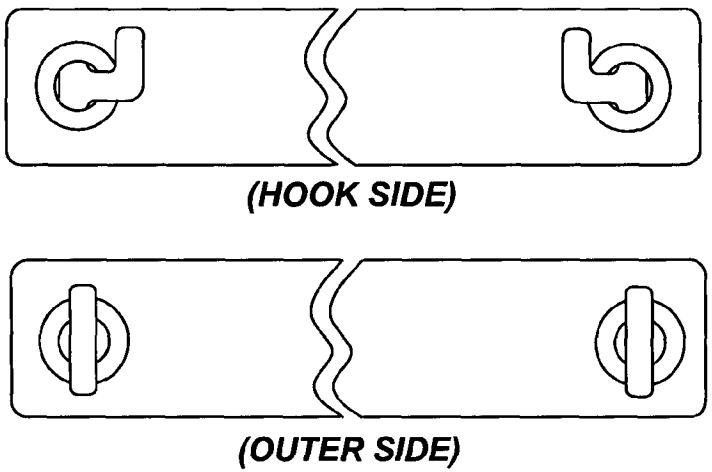

RECONFIGURABLE TRAVEL TRUNK

FIELD OF THE INVENTION

This invention relates generally to luggage and, in particular, to a versatile travel trunk that may be reconfigured for various purposes using modular, compartmentalized components.

BACKGROUND OF THE INVENTION

For over a century, people have been designing trunks and cases to hold different items in an organized manner for travel, display and other purposes. As one example of many, U.S. Pat. No. 885,979, relates to packing cases for hats comprising a cabinet having the outward finish and general appearance of a trunk and having ways therein and shelves slidable in the ways and adjustable to different distances apart so as to accommodate hats of different dimensions, and means for firmly securing a hat to each of the shelves. Although designs such as these have a hinged door, it is simply a door for closing, including no further provision for carrying any other type of article.

U.S. Pat. No. 5,797,612 resides in a carrier for hockey equipment in the form of a generally box-shaped container body which is molded in a high-impact plastic material, including a pair of wheels at its bottom rear edge. Clamps are provided on the back face of the container for frictionally retaining a pair of hockey sticks that can be used to manipulate the carrier on its wheels. The container has doors at the front, a lower one of which can be folded down to form a platform on which a hockey player can stand while changing. An upper door opens laterally. The two doors provide access to a number of wire baskets within the container body, for accommodating hockey equipment. Modularlity is limited, however, as this design is intended for a specific purpose.

A wheeled upright luggage case having oversized wheels for improved rolling movement is described in U.S. Pat. No. 6,076,641. The luggage case has a pair of wheels that are oversize in proportion to the body of the case. The oversize wheels are rotatably mounted in fender assemblies disposed on the outsides of the body of the case, so that the oversize wheels do not detract from the cargo capacity of the case. The wheels are mounted to protrude a specified relational distance from the bottom, or the back and the bottom, of the case to permit the case to be rolled while tilted at a wide variety of angles and to easily be pulled up stairs or curbs. Although the lid provides some degree of article retainment, there are no drawers or selectively securable compartmentalized features associated with the lid.

A travel organizer system is disclosed in U.S. Pat. No. 6,179,102, including an intermediate portion with a flexible carrying strap mounted thereon. A pair of side portions are hingably coupled to the intermediate portion each with a plurality of compartments formed therein for carrying various travel related items therein. However, no shelves, drawers or snap-in modules are provided.

U.S. Pat. No. 6,520,514 is directed to portable file case holder including a case housing having a rear wall, side walls, a top wall and a bottom wall for forming an interior compartment; the rear wall having an exterior wall surface and an interior wall surface; each of the side walls having an exterior wall surface and an interior wall surface; and each of the side interior wall surfaces include a plurality of paired, spaced-apart mounting receiving slots; and wherein each of the mounting receiving slots having U-shaped channels thereto for receiving the side edge of a shelving member. One or more of the shelving members for forming one or more compartments within the interior compartment of the case housing for receiving documents in the form of file folders, books, notebooks, 3-ring binders, manuscripts, transcripts, and/or computer print-outs. The case housing includes a detachable file case door having an exterior wall surface, an interior wall surface and a perimeter edging with a plurality of locking means thereon for covering the interior compartment. Notably, no drawers are provided in the back portion, and the lid carrier is specifically directed to carrying a detachable lectern component.

A wheeled upright luggage case is disclosed in U.S. Pat. No. 6,520,514. The case has wheels to allow the case to stand upright in a stable and balanced position without attendance by the user. The case has a wheel handle to allow the user to push or pull the case across a supporting surface. The case may be pushed or pulled on either four wheels or two wheels. When four wheels are used, the full weight of the case and its contents are borne by the wheels, relieving the user from having to bear any of the weight of the luggage. The body of the case is designed to have a specific range of tilt angles from the vertical; by tilting the body of the case toward the user, the design of the case improves the stability of the case while it is pushed across a supporting surface on four wheels. Various case body configurations and push handle arrangements are disclosed; however, no drawers or lid-related modules are taught.

In terms of relevant design patents, U.S. Pat. No. D152,653 shows a rear portion with adjustable shelves and a front portion with modular compartments. However, there are no drawers associated with the shelves, and the modular compartments may not be removably secured to enhance versatility.

Thus, despite these and other configurable trunk and case configurations, the need nevertheless remains for enhanced versatility, particularly in view of modern travel requirements.

SUMMARY OF THE INVENTION

This invention resides in a versatile travel trunk that may be reconfigured for numerous purposes, including a men's wardrobe, women's wardrobe, a combined wardrobe, food-carrying ("chuck wagon") applications, tool and utensil accommodation, and any combination thereof.

The preferred embodiment includes a body portion to which there is hinged a closable door portion. The body portion has an interior with a depth and opposing inner side walls adapted to receive one or more removable and reconfigurable shelves. A plurality of fasteners are disposed on the back portion of the back wall of the door to receive one or more modular inserts, each insert having a back surface connectable to the fasteners and a front surface with compartments adapted to carry a different set of items for a particular travel application. One or more of the shelves further include lower tracks to receive drawers that slide in and out of the body portion.

Numerous different inserts are disclosed for different travel purposes. Typically, a personal wardrobe insert features a plurality of pouches that may be horizontally or vertically oriented. A personal wardrobe insert may further include a holder for belts or neckwear or a removable jewelry case.

Particularly for food-carrying purposes, an insert may take the form of an open box structure with outwardly extending sidewalls and one or more elastic straps or hanging hooks.

A different one of the modular inserts includes a pegboard with removable hooks or straps for holding tools or utensils.

In each case, the modular inserts are preferably provided with side tabs to assist in removal of that insert from the door portion. The body portion also preferably further includes a set of integrated wheels and a retractable handle for ease in transport.

BRIEF DESCRIPTION OF THE DRAWINGS

FIG. 8 is a drawing of yet a different insert according to the invention in the form of a pegboard including elastic straps with grommets attachable to pegboard hooks; and FIG. 9 is a drawing of a rollable laundry bag for use with the invention.

DETAILED DESCRIPTION OF THE INVENTION

Figure 1:
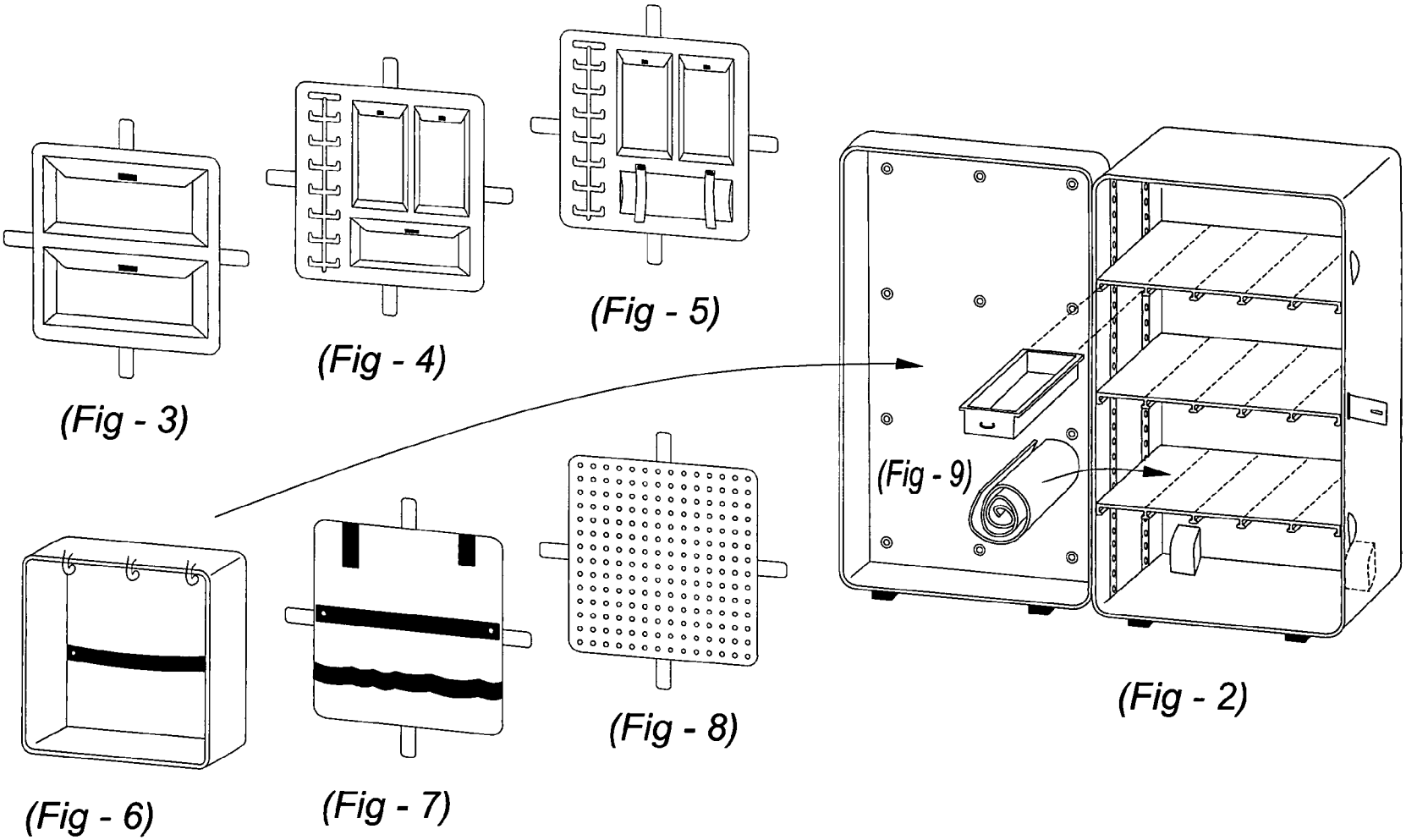
FIG. 1 is a perspective drawing depicting a preferred embodiment of the invention.
Figure 2A:
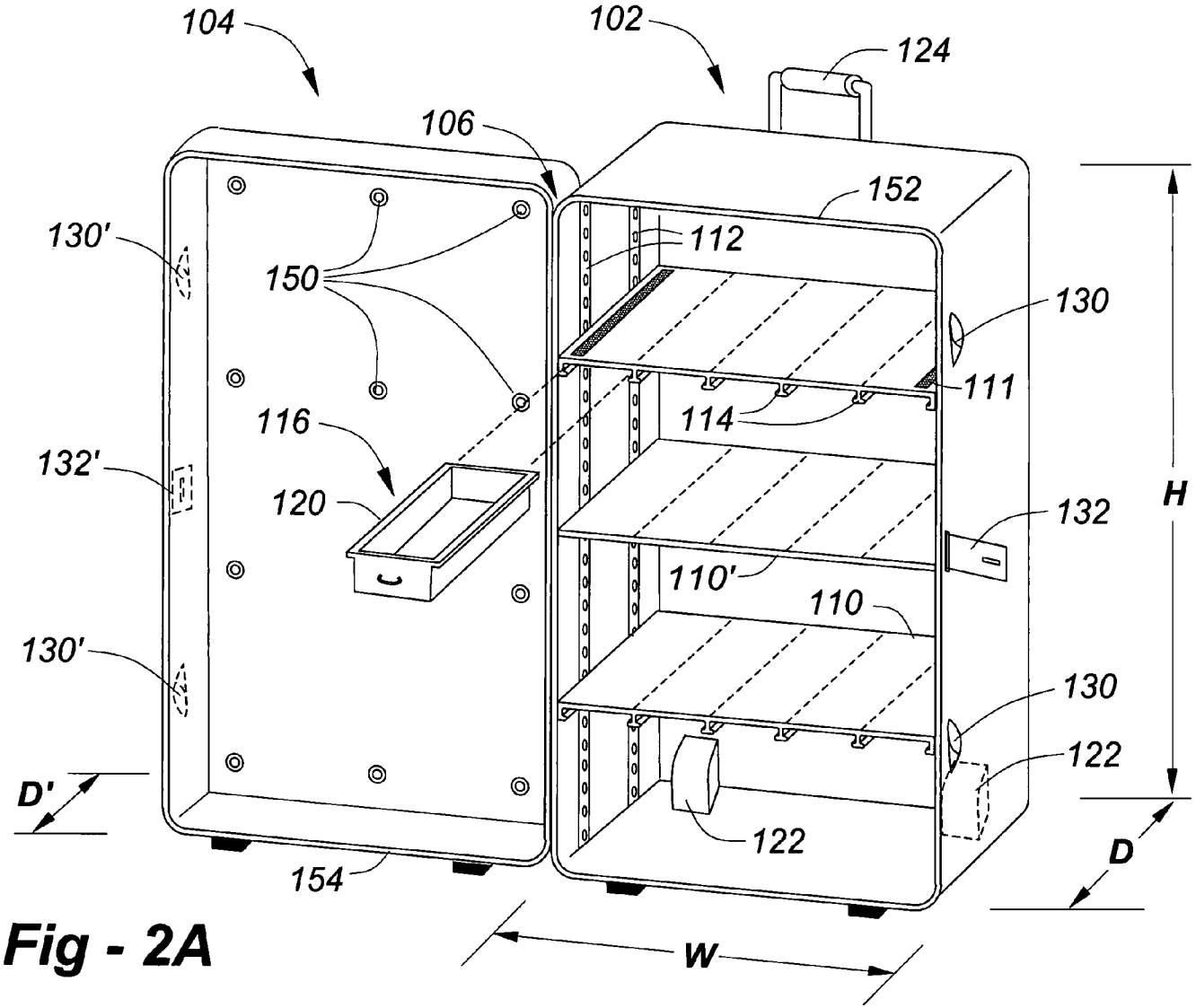
FIG. 2A is a front-view drawing of the preferred embodiment, with the door open, showing the use of configurable shelves and drawers.
Figure 2B:
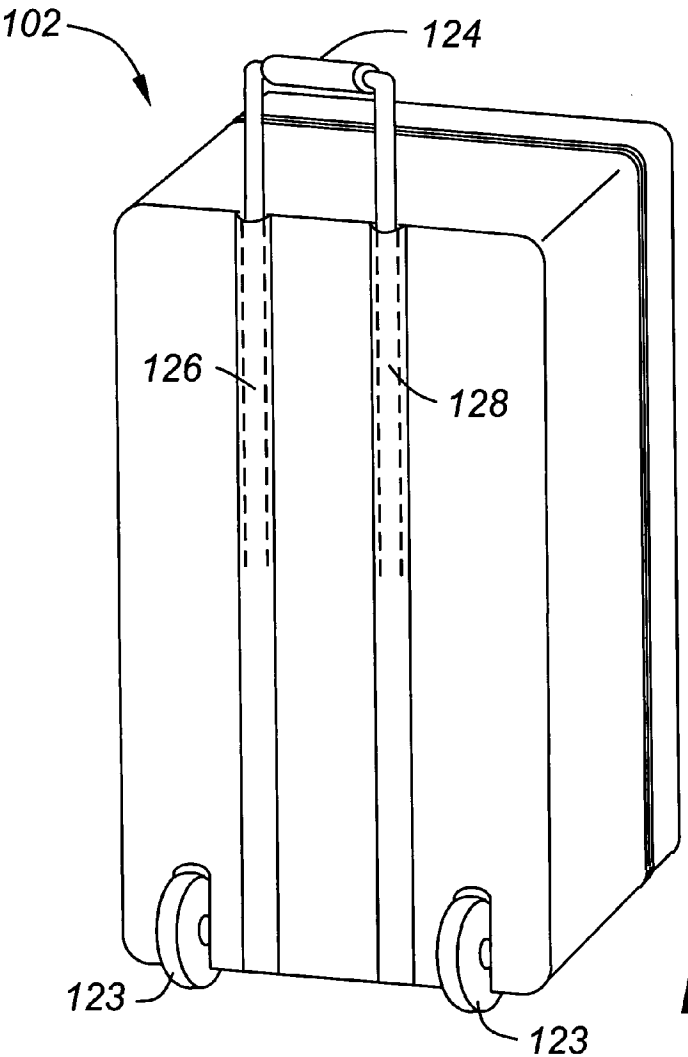
FIG. 2B is a back-view drawing of the preferred embodiment, showing a preferred use of integral wheels and retractable handle.

Turning now to the drawings, FIG. 1 is a perspective drawing depicting a preferred embodiment of the invention. The case itself is illustrated in detail in FIGS. 2A and 2B, whereas a set of convenient removable modules are shown in FIGS. 3 through 8. Not all of the possible reconfigurable modules are shown in FIG. 1, in that FIGS. 4, 5 and 8 in particular include subparts. FIG. 2A is a front-view drawing of the preferred embodiment, with the door open, showing the use of configurable shelves and drawers. FIG. 2B is a back-view drawing of the preferred embodiment, showing a preferred use of integral wheels and retractable handle.

The case itself broadly includes a body portion 102 attached to a door portion 104 through a hinge 106. The hinge 106 is preferably of the piano-type, and the door 104 may or may not be removable therefrom. In terms of dimensions, the body and lid preferably have a width W on the order of 15 inches, and a height H on the order of 30 inches. The depth of the body portion D is preferably on the order of 9 inches, whereas the depth D' of the lid portion is less, on the order of 2 inches, or thereabouts. It would be appreciated that the invention is not limited to these dimensions, though these dimensions are particularly convenient for use in air travel.

In the preferred embodiment, the body portion 102 includes a plurality of tracks 112 along opposing inner side walls to receive reconfigurable shelves 110. The tracks 112 may be added onto the side wall or integrated into the side wall, with the outer portions of the shelves including fasteners that engage with the tracks 112. For example, spring-biased fasteners may be used so that the shelves do not shift in position during transport. With such a system, numerous shelves may be installed and repositioned within the body interior. Although three shelves are shown at generally equally spaced-apart distances, more or fewer shelves at different distances may be used.

The shelves may or may not include lower drawer tracks (as is the case with shelf 110' in FIG. 2A), and hook-and-loop material 111 may optionally be provided, regardless of shelf configuration. On the other lower surface of a shelf 110, for example, the tracks 114 run from near the front edge of the shelf to back within the body interior to receive drawers 116 having upper lips 120 that cooperate with the tracks 114, thereby providing shelves that move in and out of the interior of the body.

The particular drawer shown has a width of approximately 3 inches, and a depth of just less than 9 inches, though these dimensions as well as the height of the drawer are variable. For example, although each of the shelves such as 110 is shown to accommodate five drawers, more or fewer tracks 114 may be provided to accommodate different drawers of varying width. The height or depth of each drawer may also vary, depending upon the intended application. Although the drawers may be constructed with any material, clear plastic is preferred so that the contents may be viewed as soon as the trunk is opened. The shelves also are preferably constructed of a clear plastic.

The body portion 102, as well as the door portion 104, may be constructed of any appropriate material, such as molded fiberglass, molded plastic, metal such as aluminum, or fabric/leather covered panels, as appropriate. Closures 130, which mate with twist locks 130' are provided along with hasp portions 132, 132' to secure and lock the door 104 to the body portion 102. Other types of available fasteners may alternatively be used. Wheel wells 122 intrude somewhat into the body portion to accommodate wheels 123 shown in FIG. 2, and the retractable handle 124 is preferably provided, which slide in and out of guides 126, 128, also seen in FIG. 2.

The door portion 104, in addition to the features already described, include an array of fasteners 150 to which various inserts described in further detail below are removably attached. It will be appreciated that various types of fasteners may be used in accordance with the invention, including spring-loaded barb fasteners, hook-and-loop fasteners, "Christmas tree" fasteners, "hedlock" type fasteners, and so forth. Metal trim 152, 154 is preferably provided around the openings to the body portion 102 and door portion 104, respectively.

Modular Inserts

Figure 3:
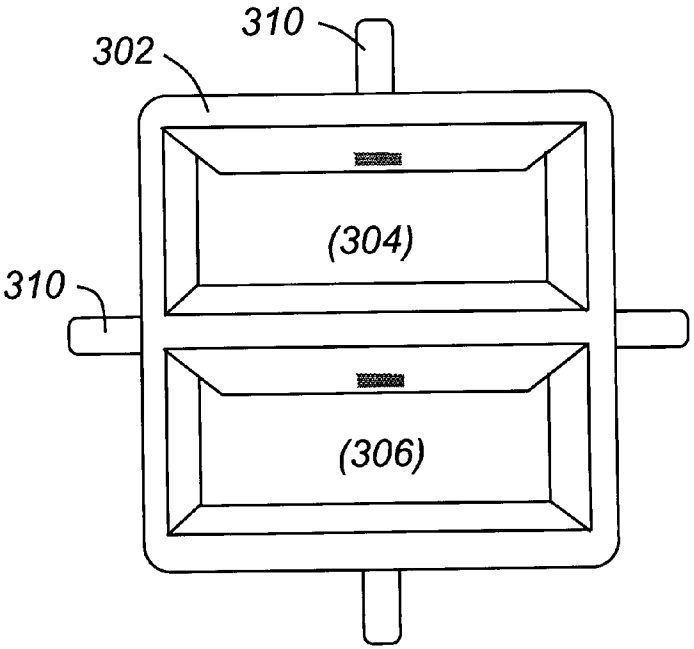
FIG. 3 is a drawing of a combination men's/women's wardrobe insert according to the invention.

Various modular inserts will now be described, each being removably attachable to the connectors 150 located on the inner back surface of the door portion 104. In FIG. 3, there is shown a basic wardrobe insert having a back surface with fasteners that mate with the connectors 150, and a front surface to which there is attached a plurality of pouches 304, 306. The pouches are preferably closable with hook-and-loop type fasteners for added security, with the dimensions of the insert being on the order of 15×15 inches, allowing two such inserts to be placed on the inside of the front door, one above the other. Like the other inserts described herein, any flat and rigid/semi-rigid material may be used, such as fiberglass, plastic, aluminum, and so forth. Tabs 310, which may be integral to the panel 302 or separate fabric tabs, allow the insert to be more easily removed from the door portion for reconfigurability.

Figure 4A:
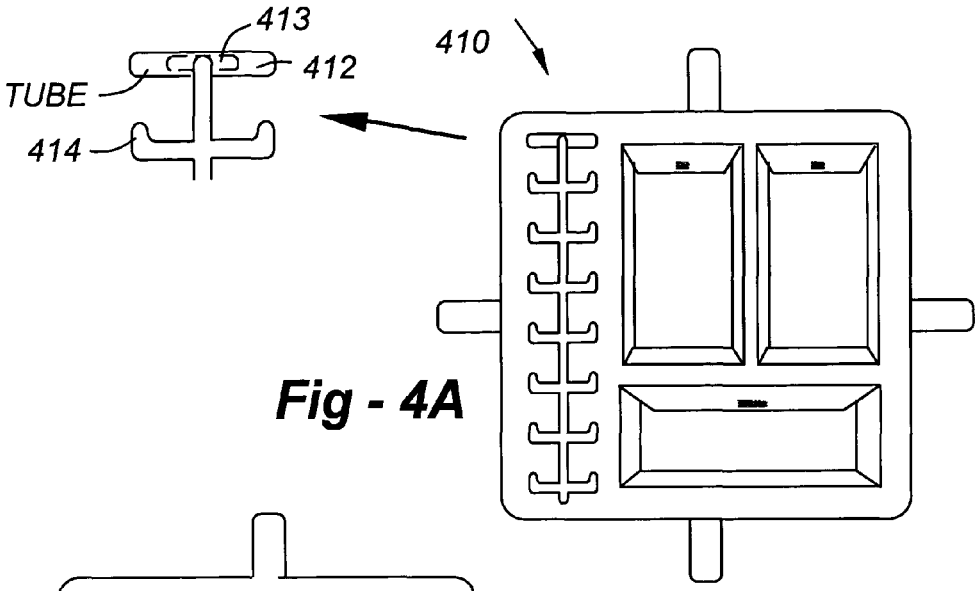
FIG. 4A is a drawing of an insert particularly suited to a man's wardrobe.
Figure 4B:
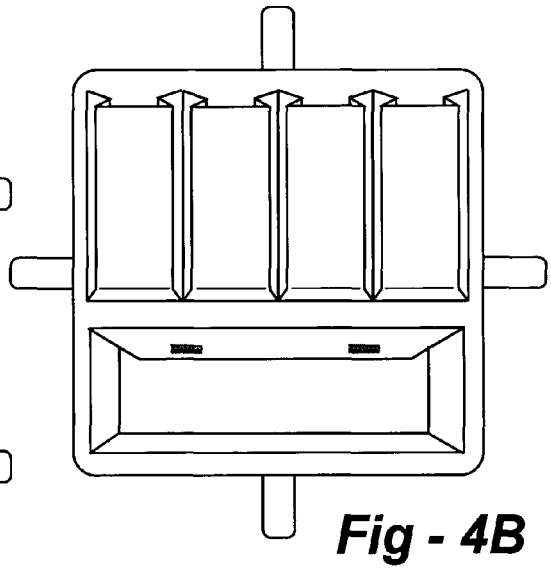
FIG. 4B is a drawing of a different insert particularly suited to a man's wardrobe.
Figure 4C:
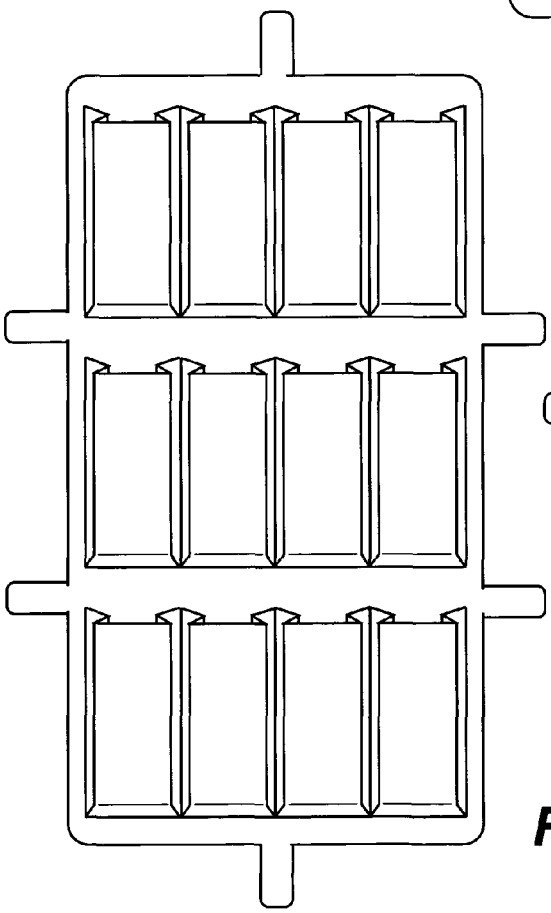
FIG. 4C is a drawing of yet a further insert particularly suited to a man's wardrobe.

FIG. 4A illustrates particularly suited to a man's wardrobe, including horizontally and vertically oriented "pouches within a pouch" and a "tree" 410 well suited to carrying belts, neckties, and so forth. The tree 410 includes hanging portion 414 with an upper T-shaped connector that fits into a tubular support 412 mounted to the panel of the insert allowing the tree to pivot outwardly and back down onto the panel of the module. FIG. 4B is a drawing of a different insert particularly suited to a man's wardrobe, including a set of open pouches, as for shoes and the like, provided in conjunction with a closable pouch. FIG. 4C is a drawing of yet a further insert particularly suited to a man's wardrobe, in this case providing a numerous open pouches.

Figures 5A, 5B:
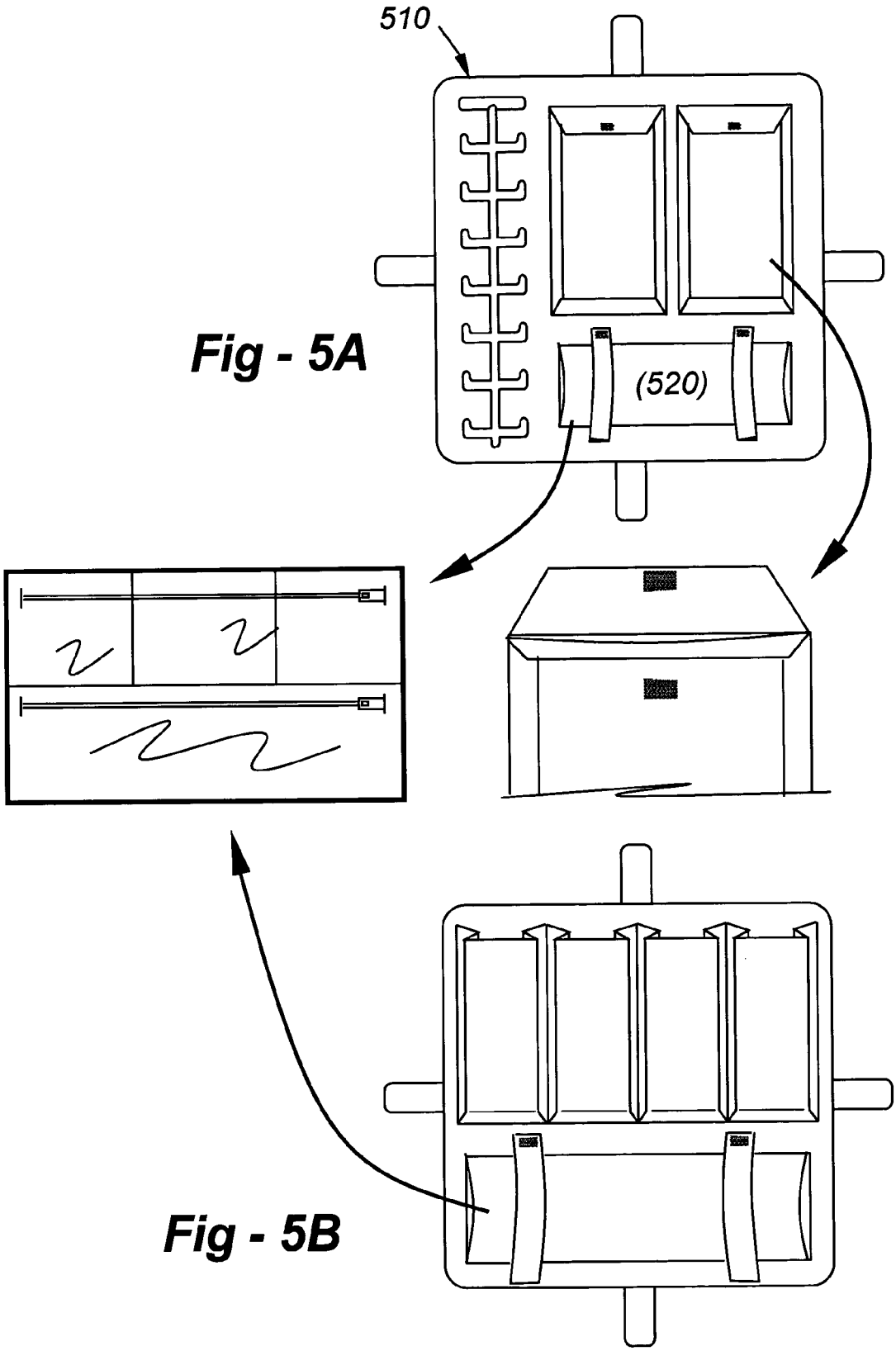
FIG. 5A is a drawing of an insert particularly suited to a woman's wardrobe.
FIG. 5B is a drawing of a different insert particularly suited to a woman's wardrobe.

FIG. 5A is a drawing which shows an insert more suited to a woman's wardrobe. In addition to a plurality of pouches which may be horizontally or vertically oriented, this configuration also includes a tree 510 and a removably case 520 particularly suited to carrying jewelry. FIG. 5B is a drawing of a different insert particularly suited to a woman's wardrobe, including a set of open pouches, as for shoes and the like.

Figure 7:
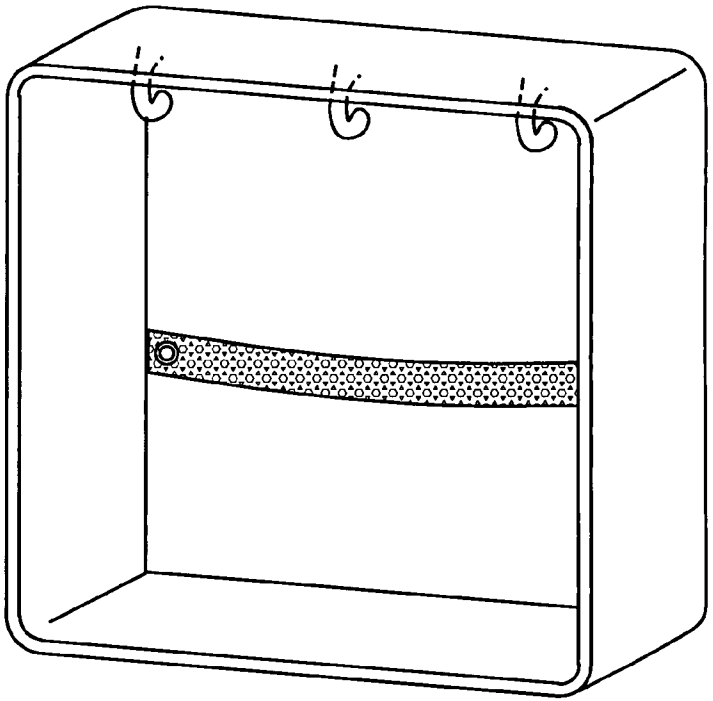
FIG. 7 is a drawing of a chuck wagon insert including straps and hooks.
Figure 6:
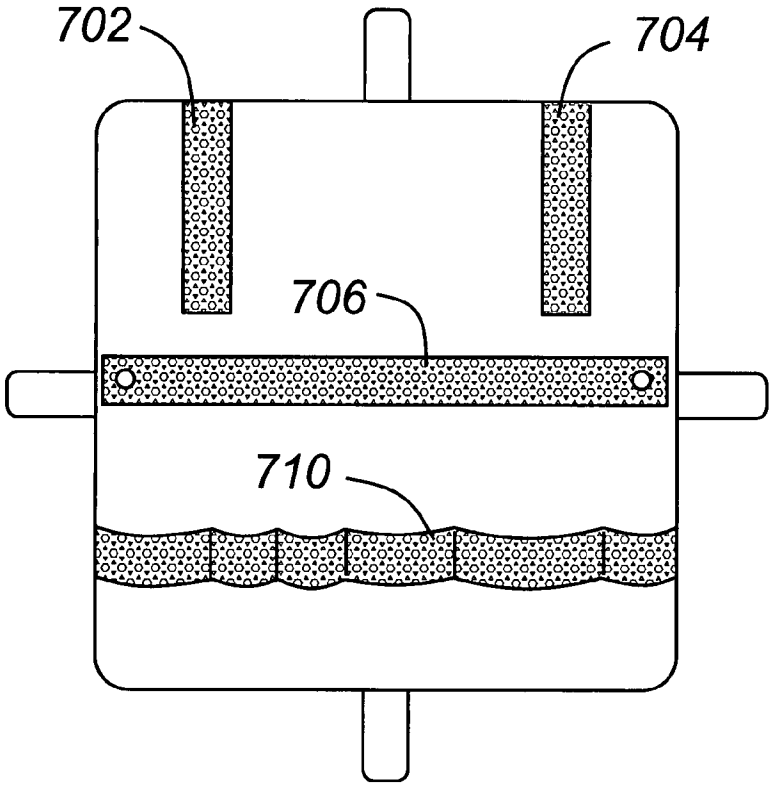
FIG. 6 is a drawing of a different insert, including straps and elastic features suitable for tools, utensils, and so forth.

FIG. 6 illustrates a different insert for chuck wagon, tool or utensil storage having a hook-and-loop connectors 702 and 704, an optional elastic strap with snaps 706, and a different optional elastic portion 710 with multiple sections to accommodate differently sized implements. FIG. 7 illustrates yet a further insert for carrying food or other "chuck wagon" related purposes. This particular insert assumes the form of a structure, with one or more elastic straps connected by snaps or hooks for carrying different food items or other articles.

FIG. 8 is a drawing of a yet different insert, in this case, taking the form of a pegboard 810 which uses hooks such as that shown in 820 attachable to the holes in the pegboard. To the hooks 820 one can attach elastic straps of varying length having grommets, thereby allowing for the provision of varying length holders for different articles and implements, depending upon the application. FIG. 9 is a drawing of an optional laundry bag according to the invention, preferably constructed of white nylon having a drawstring opening and a pair of hook-and-loop strips attached to the shelves or the bottom of the case, allowing the bag to be rolled up in an empty form, or including clean or dirty clothing, and placed on one of the shelves carried by the body interior.

I claim:

1. A configurable travel trunk, comprising:

a body portion having an interior with a depth and opposing inner side walls;

one or more shelves disposed within the interior of the body portion, each shelf extending from one of the side walls to the other;

a closable door portion hinged to the body portion, the door portion having an interior with a back wall defining a door depth;

a plurality of fasteners disposed on the back portion of the back wall of the door;

a plurality of modular inserts, each insert having a back surface connectable to the fasteners and a front surface with compartments adapted to carry a different set of items for a particular travel application;

one or more removable and reconfigurable shelves with lower tracks;

a drawer configured to slide in and out on the tracks; and wherein the body portion includes a set of integrated wheels and a retractable handle.

2. A configurable travel trunk, comprising:

a body portion including a pair of integrated wheels, a retractable handle, and an interior with a depth and opposing inner side walls;

the inner side walls of the body portion including vertical tracks configured to receive a plurality of removable and reconfigurable shelves, each shelf including a set of lower tracks;

one or more sliding drawers received by the shelf tracks;

a closable door portion hinged to the body portion, the door portion having an interior with a back wall defining a door depth less than that of the body portion;

a plurality of fasteners disposed on the back portion of the back wall of the door; and a plurality of modular inserts connectable to the fasteners on the door portion, the inserts including one or more of the following:

a personal wardrobe insert providing a plurality of pouches, an open box structure with one or more elastic straps or hooks for hanging, and a pegboard adapted to carry tools or utensils.

3. The configurable travel trunk of claim 2, including modular inserts having side tabs to assist in removal of that insert from the door portion.

4. The configurable travel trunk of claim 2, wherein one of the modular inserts includes a shoe pouch.

5. The configurable travel trunk of claim 2, further including a laundry bag that can be rolled and fitted on one of the shelves.

* * * * *